US005642422A

United States Patent [19]

Hon et al.

[11] Patent Number: 5,642,422

[45] Date of Patent: Jun. 24, 1997

[54] DIGITAL SURROUND SOUND METHOD AND APPARATUS

[75] Inventors: Stephen Yik-fai Hon; John Vincent Taglione, both of Scarborough, Canada

[73] Assignee: International Business Machines Corporation, Armonk, N.Y.

[21] Appl. No.: 399,272

[22] Filed: Mar. 6, 1995

[30] Foreign Application Priority Data

Jun. 28, 1994 [CA] Canada ..... 2126903

[51] Int. Cl.[6] ..... H04R 5/00

[52] U.S. Cl. ..... 381/19; 381/1

[58] Field of Search ..... 381/61, 63, 24, 381/18, 19, 1

[56] References Cited

U.S. PATENT DOCUMENTS 4,237,343 12/1980 Kurtin et al. ..... 381/63

4,968,154 11/1990 Baeg ..... 381/18

5,323,272 6/1994 Klingler ..... 360/8

*Primary Examiner*—Curtis Kuntz

*Assistant Examiner*—Ping W. Lee

*Attorney, Agent, or Firm*—Casimer K. Salys

[57] ABSTRACT

Method and apparatus for implementing surround sound in an audio system having a number of audio output devices, and audio output buffers associated with the audio output devices adapted to output audio data in order of receipt. A block of delay data is loaded into a buffer associated with a rear audio output device. Audio data is directed to the audio output devices, by way of the buffers. In the operation of the system, data stored in the buffers is transferred from the buffers to the associated audio output devices. The audio data will be delayed reaching the rear audio output device until the delay data has been output from the buffer resulting in a surround sound effect.

3 Claims, 9 Drawing Sheets

```
FUNCTION = Play_surround

Play_surround ( )
{
Read File Header from file - RIFF Format
    Read_Riff_Header ( ) ;

Power on and Initialize Card 1 & 2
    Mode_Init (Card_1) ;
    Mode_Init (Card_2) ;

Write silence pattern to buffer 4R
    Write_blank_buffer ( ) ;

Read first Block of data from file to Buffer 4F
    fread(&audio_buffer[0], sizeof(char), 2048, audio_file) ;

Process data in Buffer 4F and put in Buffer 4R
    Calc_rear_buffer (2048) ;

Transfer data from Memory Buffer 4F to Hardware FIFO 14F
    PCMCIA_Write_Block (audio_buffer, 1024, Card_1) ;

Transfer data from Memory Buffer 4F to Hardware FIFO 14R
    PCMCIA_Write_Block (audio_buffer1, 1024, Card_2) ;

Read next block of data from file to Buffer 4F
    fread (&audio_buffer[0], sizeof(char), 2048, audio_file) ;

Process data in Buffer 4F and put in Buffer 4R
    Calc_rear_buffer (2048) ;
```

FIG. 9A

Begin playback

```
continue_flag = TRUE;
Start_DMA (Card_1) ;
Start_DMA (Card_2) ;
Set_volume_dual ( ) ;
```

Test if End of File

```
while ((continue_flag == TRUE) & ( ! feof(audio_file)))
    {
```

Test Key Pressed

```
        if (kbhit( ))
          {
```

Process Key

```
            interactive_control_dual ( );
          }/* end if */
```

Is FIFO 14F less than Half Full

```
        fifo_status = inp(Card_1_Int_Status_Reg) ;
        if (fifo_status & 0x08)
          {
```

Transfer data from Memory Buffer 4F to Hardware FIFO 14F

```
            PCMCIA_Write_Block(audio_buffer, 1024, Card_1);
```

Transfer data from Memory Buffer 4R to Hardware FIFO 14R

```
            PCMCIA_Write_Block (audio_buffer1, 1024, Card_2) ;
```

Read next block of data from file to Buffer 4F

```
bytes_from_file = fread (&audio_buffer[0], sizeof(char), 2048, audio_file) ;
```

Process data in Buffer 4F and put in Buffer 4R

```
            Calc_rear_buffer (bytes_from_file) ;
        } /* end if */
    } /* end while */
```

FIG. 9B

Transfer last data from Memory Buffer 4F to Hardware FIFO 14F

```
PCMCIA_Write_Block (audio_buffer,bytes_from_file,Card_1) ;
```

Transfer last data from Memory Buffer 4R to Hardware FIFO 14R

```
PCMCIA_Write_Block (audio_buffer,bytes_from_file,Card_2) ;
```

Wait for playback completion

```
while (!(inp(Card_1_Int_Status_Reg) & 0x10)) ;
```

Clean up and Exit Program

```
Stop_DMA(Card_1) ;
Stop_DMA(Card_2) ;
Silence_Card(Card_1) ;
Silence_Card(Card_2) ;
fclose(audio_file) ;
}/*  end Play_surround  */
```

Function = Calc_rear_buffer()
RL = FL - FR = -RR

```
Calc_rear_buffer(int max_count)
{
    for (i=0;i<max_count;i=i+4)
    {
        temp0 = audio_buffer[i+1]<<8 | (audio_buffer[i+0] & 0x00FF) ;
        temp1 = audio_buffer[i+3]<<8 | (audio_buffer[i+2] & 0x00FF) ;
        temp2 = temp0 - temp1 ;
        temp3 = temp1 - temp0 ;
        audio_buffer1[i] = temp2 & 0x00FF ;
        audio_buffer1[i+1] = temp2 >> 8 ;
        audio_buffer1[i+2] = temp3 & 0x00FF ;
        audio_buffer1[i+3] = temp3 >> 8 ;
    } /* endfor */
} /* end Calc_rear_buffer */
```

FIG. 9C

```
FUNCTION = Write_blank_buffer()
           Write zero to the bottom of rear buffer as delay
```

```
Write_blank_buffer( )
{
    for (i=0;i < 4096;i++)
      {
        audio_buffer1[i] = 0 ;
      } /* endfor */

    PCMCIA_Write_Block(audio_buffer1,2048,Card_2) ;
    PCMCIA_Write_Block(audio_buffer1,2048,Card_2) ;
    PCMCIA_Write_Block(audio_buffer1,2048,Card_2) ;
    PCMCIA_Write_Block(audio_buffer1,256,Card_2) ;

} /* end Write_blank_buffer */
```

FIG. 9D

DIGITAL SURROUND SOUND METHOD AND APPARATUS

FIELD OF THE INVENTION

The present invention relates to an audio system which is capable of producing surround sound from digitally stored audio data.

BACKGROUND OF THE INVENTION

Consumer stereo audio systems implementing surround sound typically extract from two stereo channels (Right and Left) an additional channel which contains the out of phase or ambience information which is contained in the original two channels. This ambience information is obtained by deriving the difference in the signal content between the right and left channels in a stereo system. This ambience information can either be fed through a single rear channel to a single speaker or, to spread the information across the full rear of the sound field, be fed through two rear channels with one channel being 180 degrees out of phase with the other to two rear speakers.

The signal processing required to do this is simply a subtraction of the left channel from the right channel. The compliment is done to extract the second rear channel, that is, the right channel minus the left channel.

Single Rear Channel Implementation

Rear=(Left–Right)

Two Rear Channel Implementation

Rear Left=(Front Left–Front Right)

Rear Right=(Front Right–Front Left)

Front Channels

Front Left=Front Left

Front Right=Front Right

In another variation of surround sound called concert mode the signal provided to the rear speaker or speakers as the case may be is obtained using the formula (Right+Left) /2.

Yet another variation of surround sound uses a center front channel obtained according to the formula (Right+ Left)/2 with the rear channel(s) using the difference information as described previously.

Prior art surround sound systems have been typically implemented as standalone units with the surround processing being done using analog techniques including analog delay lines, such as charge coupled devices, to generate a time delay element between the front and rear channels. These systems tend to be of limited flexibility.

SUMMARY OF THE INVENTION

The invention herein provides a method of implementing surround sound for an audio system having a number of audio output devices (such as front and rear speakers) and audio output buffers adapted to output audio data in order to receipt (preferably FIFO buffers) associated with at least one of the audio output devices (the rear speakers usually).

A block of delay data is loaded into the buffer or buffers for the rear speakers preferably.

Audio data from a stored audio selection is directed to the audio output devices, by way of the buffers where present.

Data stored in the buffers is transferred from the buffers to the associated speakers to play all audio selection.

The audio data will be delayed reaching an audio device associated with the buffers containing delay data until the delay data has been output from said buffer means. This will convey a sense of depth or surround effect depending on the amount of delay imposed as will be appreciated.

Another aspect of the invention provides apparatus for implementing surround sound for an audio system having front and rear audio output devices and audio output buffer means, associated with each audio output, adapted to output audio data in order of receipt; in which means are provided:

for loading a block of delay data into at least one of the buffers;

for loading audio data into each of the buffer means; and for causing data stored in the buffers to be transferred from said buffer means substantially simultaneously to the associated audio output devices;

whereby the audio data will be delayed reaching an audio device associated with the buffer means containing delay data until the delay data has been output from the buffer means.

Another aspect of the invention provides a program for implementing surround sound for an audio system having front and rear audio output devices and audio output buffer means associated with each audio output device adapted to output audio data in order of receipt, comprising:

a routine for loading a block of delay data into at least one of the buffers;

a routine for loading audio data into each of the buffers;

a routine for causing data stored in the buffers to be transferred from the buffers substantially simultaneously to the associated audio output devices.

When the program is operated on a suitable audio system the audio data will be delayed reaching an audio device associated with the buffer or buffers containing delay data until the delay data has been output therefrom.

BRIEF DESCRIPTION OF DRAWINGS

FIGS. 9A–9D represent a source code in C language for the implementation of FIG. 8.

DESCRIPTION OF AN EMBODIMENT OF THE INVENTION

In the present invention, the surround sound processing and signal delay implementation is done preferably in a purely digital manner with the signals being converted into an analog form at the last step in the process. In addition, the signal processing may be done with a general purpose processor rather than a dedicated a Digital Signal Processor (DSP).

The additional processing load on the host processor over a system which is operating as a normal stereo system with data buffered in a first set of buffers is the generation of the rear channels and moving the additional data to a second set of buffers. This is not a large burden on most modern processors found in the current generation of personal computers; it is well within the capability of the system host processor and would not typically require a DSP.

Figure 1:
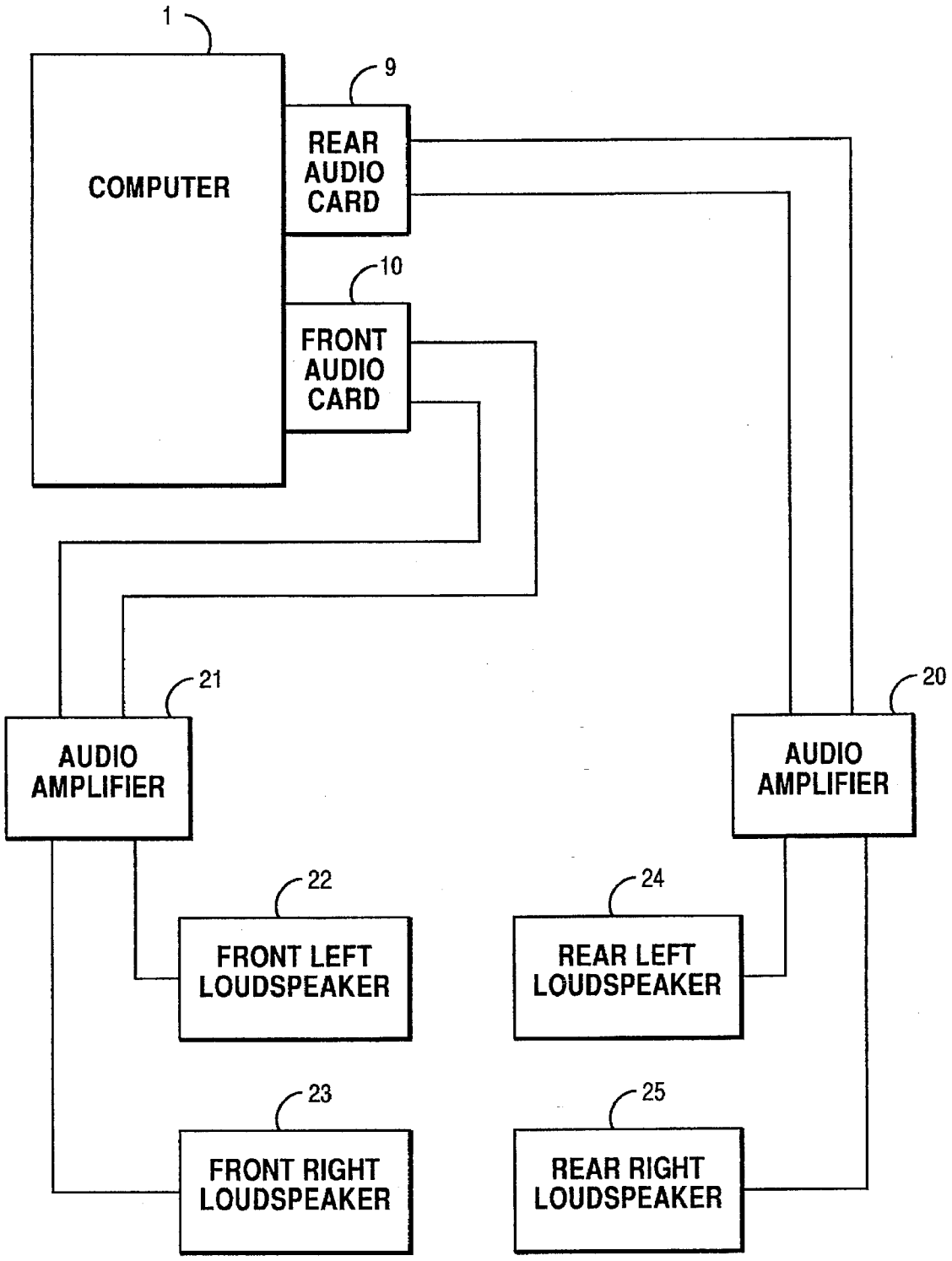
FIG. 1 is a block diagram of a computer implemented surround sound system.

Referring to FIG. 1 the method and apparatus of the invention is capable of implementing a surround sound system in a personal computer 1 such as a laptop which can support two audio cards 9, 10. Typically the system would use external amplifiers 20, 21 to drive front speakers 22, 23 and rear speakers 24, 25. In a specific implementation, the system of the invention was implemented using two PCMCIA stereo audio cards. But the basic principle can be extended to any system which can support four audio channels.

The method by which the invention herein implements the delay between the front and rear channels has a distinct advantage over the traditional CCD bucket brigade device used in analog systems. No additional limitation is placed on the frequency response in the rear channels, unlike the CCD method. In particular, the change in frequency response when the delay is altered in a CCD system occurs as the multiphase clock generator's clock frequency is changed. When the delay is increased, by reducing clock frequency, high frequency response suffers. This does not occur with the present invention.

The invention herein is particularly well suited to audio cards having large FIFO buffers such as are used in some PCMCIA stereo audio cards. The FIFO buffer structure of PCMCIA audio cards can be used to achieve a method of generating a variable time delay between the front and rear channels without adding any additional processing burden on the host processor other than when a delay is inserted, e.g. at initialization or delay adjustment.

A characteristic of a FIFO buffer is that as data is written into one end, data will appear at the other end of the FIFO. Once data is written in the FIFO, the host system does not have to manipulate any address information in order to use the FIFO. As the data is read from the output of the FIFO, it will appear in the order in which it was written into the FIFO.

A FIFO buffer can be emulated with a RAM buffer and two address pointers with one pointer pointing to the location where data was last written and the other are to the location of the point where data was last read.

When data is read from the buffer the read pointer is incremented until the address of the read pointer equals the address of the write pointer. The quantity of the data in the buffer is proportional to the difference between the addresses of the read and write pointers and can be used to set a flag or indicator for the amount of data contained in the FIFO. A flag indicating a partially empty buffer can be set and used so that additional data can be called for.

In a pcmcia digital stereo audio card with which this invention may be used, the D/A converters of the audio card are fed from the output of the FIFO. The D/A converters convert the digital information back into analog form which is then fed to an analog audio amplifier and speaker system. The sample rate of the data as it was originally recorded will determine very precisely the rate at which the data must be read out of the FIFO so that the pitch or frequency of the original recording will be maintained in playback.

The FIFO structures of these audio cards are used by one implementation of the invention herein to implement surround sound where one card is used for front sound and another one for rear sound. The FIFO in the card feeding the front sound channels and the FIFO in the card feeding the rear sound channels are skewed in time by padding the rear FIFO initially preferably with the digital equivalence of silence. The front and rear FIFOs are then fed respectively with the front and rear signal data. The effect obtained is that when playback is initiated the Front Audio Card will begin to play the front channels while the Rear Audio Card must play the padding or silence before the rear channel signals can propagate through the rear FIFO and be played. The period required to pass the padding or silence through the FIFO is equal to the delay between the front and rear channels. This value can be changed by increasing or decreasing the amount of padding used.

The significant advantage occurs where once the FIFO sound data output has been delayed initially, the delay will continue without having to involve the host processor. The host processor will only need to continue feeding both FIFOs without any additional work required to maintain the time delay between the Front and Rear channels.

The time delay introduced by the invention may be estimated by the following equation:

$$\frac{(\text{No. of padding bytes})/(\text{bytes/sample})}{(\text{No. of Samples/second})} = \text{time delay in seconds}$$

Figure 2:
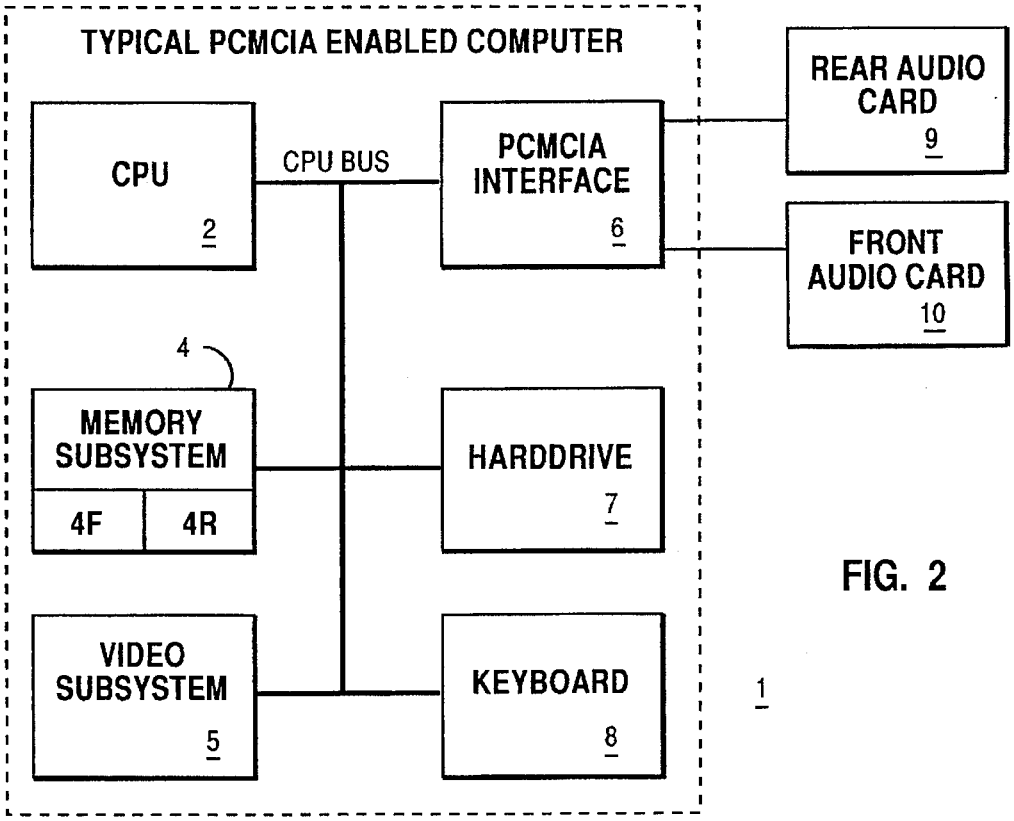
FIG. 2 is a block of the subsystem of a PCMCIA enabled computer with two audio cards.

In a preferred mode of the invention, which can be used on a PCMCIA enabled computer of FIG. 2, one or more files containing data representing an audio recording such as music or voice or a combination of the two are stored on the hard drive 7 or CD-rom of the computer 1, for instance, are accessed by the software of the invention and processed for delivery by audio cards 9, 10 to a listener using a speaker system. When executed, the software of the invention accesses the header of the audio file or the hard drive or CD-ROM (in this example) desired and reads the information contained therein, to use the information to initialize the audio adapter cards 9, 10 of the computer. The file header referred to contains information identifying whether the audio data format is mono or stereo, the recording sampling size and rate, and recording mode, such as, linear or compressed.

Figure 3:
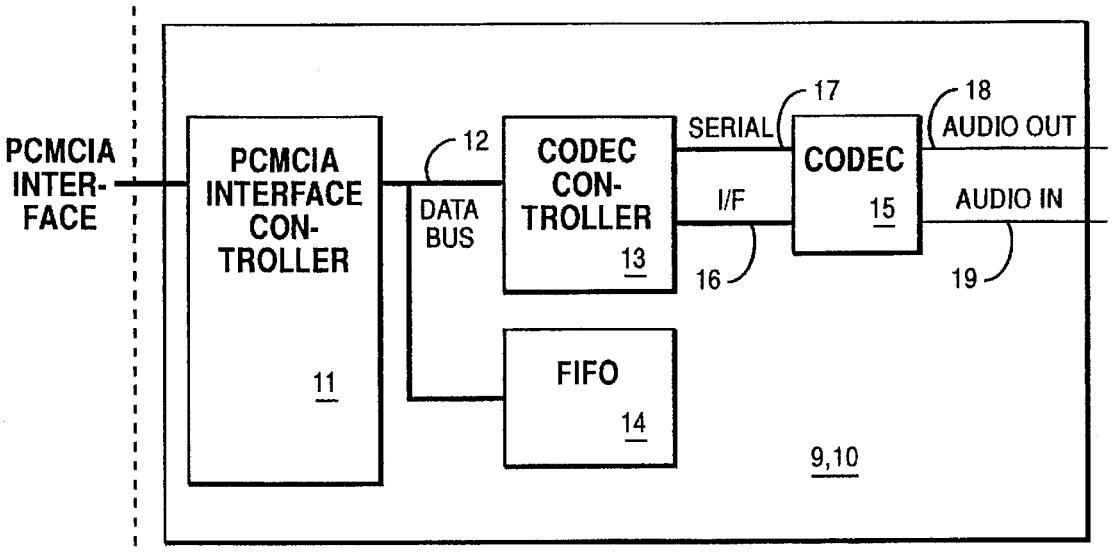
FIG. 3 is a block diagram of a PCMCIA audio card.

With this information, referring to FIG. 3, the Codec controller 13 and Codec 15 in the audio adapter cards 9, 10 are configured by the software for compatibility with the audio data format, sampling used, and the recording mode used for the recording.

Two pairs of buffers are used in the implementation of this mode of the invention; one pair is comprised of the hardware FIFO buffers 14F and 14R present, in the front channel and rear channel audio cards respectively. Referring to FIG. 2 one pair of memory buffers, 4F and 4R are established by the software in the host computer RAM memory 4.

The RAM buffers 4F and 4R are used to avoid delays in data fetching from the file storage device used. It is well known that hard drives and CD toms have long access times in comparison to system memory access times and it would be undesirable to have gaps introduced in the playing of a musical or other audio selection by fetching delays.

If it is desired to implement a delay in the sound produced by the rear speakers 24,25 (see FIG. 1), connected to the computer system to implement a surround sound effect the software herein is adapted to load a predetermined amount of delay data, corresponding to a desired time delay interval into the FIFO buffer 14R of the rear audio card 9. The loading can be done directly to the FIFO buffer 14R or can be done by double buffering, loading through RAM buffer 4R to FIFO buffer 14R. It is understood that if it is desired to delay the sound from the front speakers 22, 23 rather than from the rear speakers then delay data can be loaded into the corresponding FIFO buffer 14F and RAM buffer 4F of front audio card 10.

The delay data referred to above preferably consists of data that will not produce sound through the speaker system. It is preferable to select a series of values for the data that correspond to the zero crossing point of the encoding mode of the audio recording so that undesired noise will be suppressed for the initial playback interval. Other values for the delay data could be selected but might result in undesirable audio output initially.

After the desired delay data is loaded into the appropriate FIFO buffer (the FIFO buffer 14R of the rear audio card 9 for instance) an initial block of audio data for the desired selection is loaded by the software into RAM buffer 4F. An audio data decoding routine in the software of the invention then processes the data in RAM buffer 4F to derive rear channel information which is then placed in RAM buffer 4R.

The data in buffers 4F and 4R is now ready for loading into the audio cards. The software of the invention loads the FIFO buffers 14R and 14F of the front and rear audio cards 10, and 9, respectively, and then fetches a subsequent block of audio data from the audio file into RAM buffer 4F and the audio decoding routine repeats the audio processing as aforementioned to generate the next portion of audio information which is loaded into RAM buffer 4R.

Figure 4:
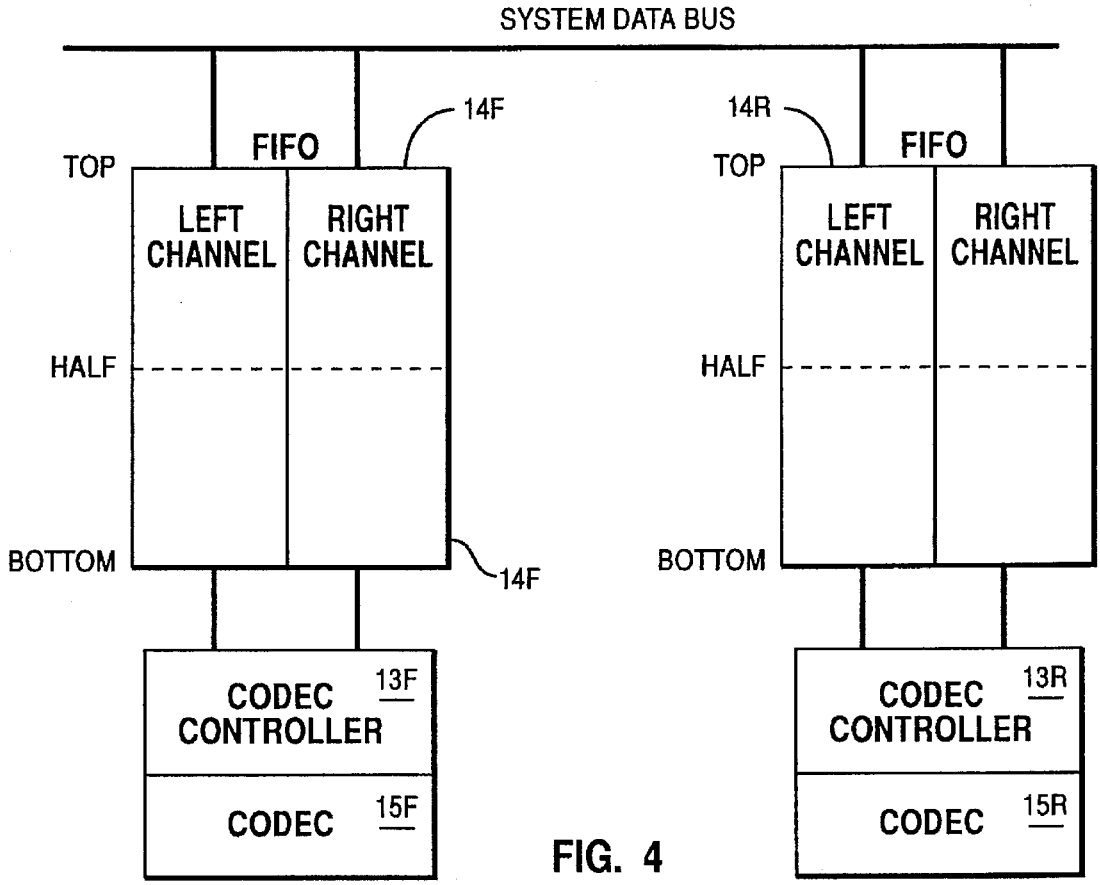
FIG. 4 is a block diagram of the FIFO and control structure of a PCMCIA audio card.
Figure 5:
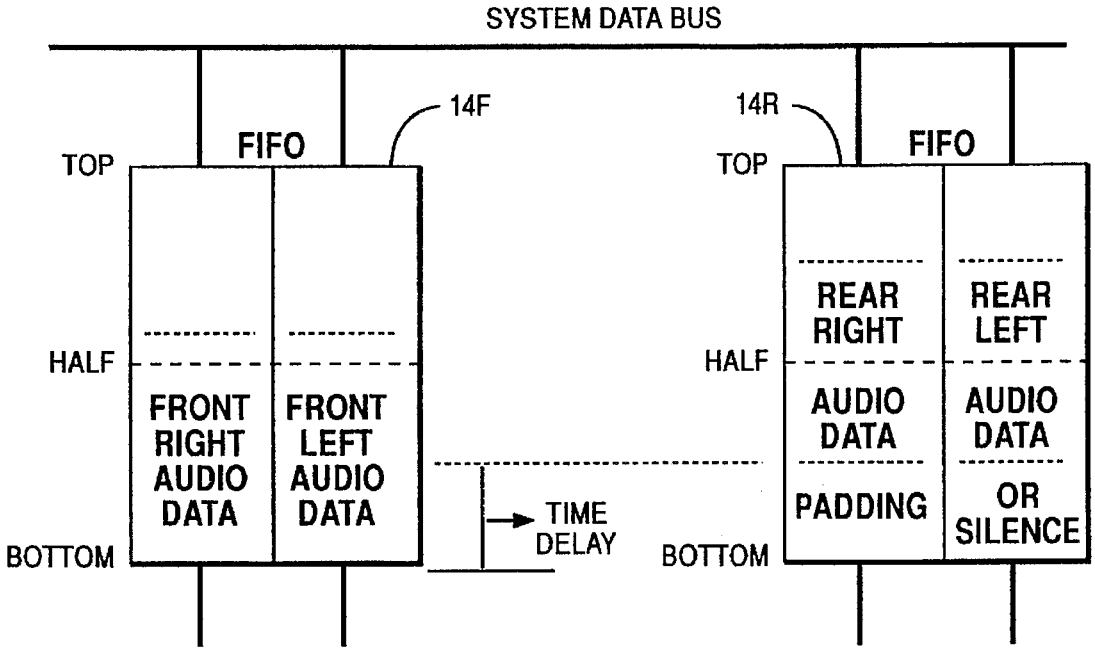
FIG. 5 is a block diagram of the FIFO controls of a PCMCIA audio card with surround sound data contained therein.

Referring to FIG. 4, the start playback routine of the software of the invention then signals the codec controllers 13F and 13R in front and rear audio cards 10, 9 respectively to initiate the operation of their CODEC's 15F and 15R respectively which start reading data from FIFOs 14F and 14R. Because of the delay data loaded into FIFO buffer 14R of the rear audio card 9, the audio selection will commence playing from the front speakers 22, 23 (shown in FIG. 1) first, followed by the rear audio portion from the rear speakers 24,25, which has been delayed by the desired time delay interval.

As the audio selection is being played, the audio data remaining in the FIFO buffers 14F and 14R is reduced. Each of the audio cards generates an indicator (e.g. flag) when the audio data in the respective FIFO falls below a predetermined level, e.g. half full or less. The software of the invention monitors the indicator flag of the front card and when the flag is asserted, the software transfers the contents of the RAM buffers 4F and 4R to the corresponding FIFO buffers 14F and 14R and initiates the fetching of a subsequent audio data block (of 1000 words for example, in this embodiment) and processes it as above. This is continued until the end of the audio file is reached or a command is issued by the user to terminate the playback operation.

When activity on keyboard 8 is detected which corresponds to a request for increasing delay time between front and rear speakers, the software of the invention adds an additional amount of delay data (0's) to the data previously transferred from the memory buffer 4R to the FIFO buffer 14R. In the preferred embodiment illustrated, delay data may be inserted in 100 word blocks (which are of a practical length) so that the data transferred from buffer 4R to 14R will be increased to 1100 words, for instance, instead of the normal 1000 words. This will result in delaying the playing of the next block of data by the time corresponding to the playing of 100 words thus increasing the delay as desired.

Where a reduction in the delay is described the corresponding keyboard instruction results in the software removing a 100 word segment from the next block of data transferred from buffer 4R to 14R resulting in a transfer of 900 words. Thus a subsequent block of data will be played earlier by an amount of time corresponding to 100 words in length. In the extreme case, where multiple reductions of delay are requested by the user, the rear channel sound can precede the front channel. Conventional surround sound systems don't appear to be capable of accomplishing this reversal.

If the half full flag is not asserted then the software of the invention inquires whether input has been received from the user (e.g. via the keyboard 8) and if so processes it. The input can include pause, changes in volumes, balance, delay, and termination of the program. If there is no user input, e.g. no keyboard activity is detected, then the software will continue polling the half empty flag of the front card until the end of the audio file is reached at which time the audio portion will cease.

In a conventional audio system, the function of balancing multiple channels is normally accomplished using analog potentiometers with log and antilog tapers. In the purely digital environment of a personal computer, in particular a portable laptop, it is not practical to design and use an external analog unit to accomplish this function. A preferred implementation of the invention here depicts a method of accomplishing the same function in a digital system by simulating the analog controls through software in accordance with the invention and digital controls presently available in laptop computers among other. For this embodiment, the directional keys of the computer maybe used to adjust the simulated controls.

Figure 6:
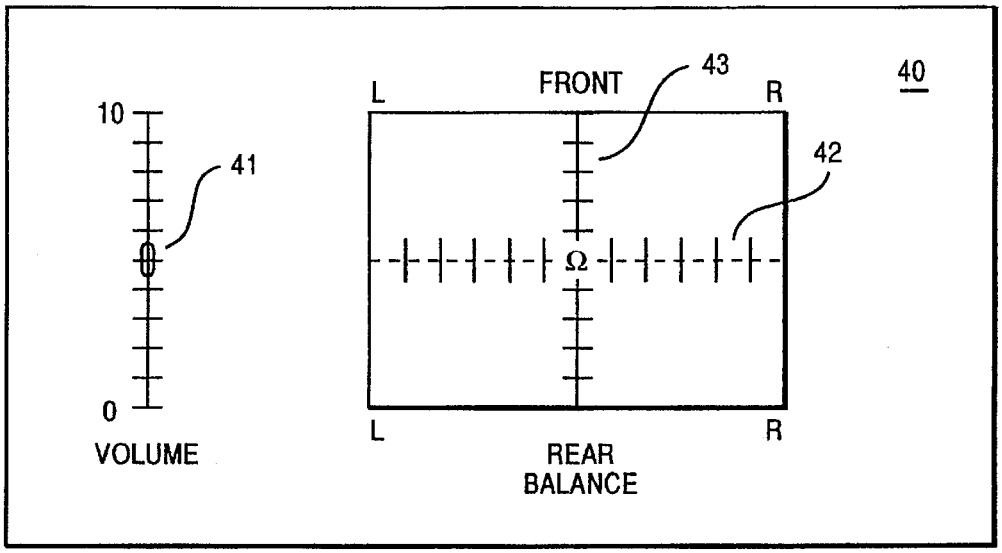
FIG. 6 is a diagram of a display of a computer using one implementation of this invention.

The controls for the volume and balance are displayed graphically using the video monitor of computer 1 as depicted in FIG. 6 in the form of linear potentiometers. The master volume control is a single pot 41 which sets the overall sound level. The balance is controlled by two linear "pots" which represent an x and y coordinate system where the left-right movement of the x 42 pot controls the volume changes in the left and right direction. Likewise, the y pot 43 controls the volume changes in the front to back direction. The graphical representation of these two controls is in the form of a vector display 40 where the x and y values represent a single movable point in a two dimensional field. The position of intersection of the x and y values represents the point in the sound field where the sound pressure level from each of the four channels is equal. Whenever there is a change in the x and y values, each of the four channels must be adjusted individually in order to move center of the sound field to the new position.

Figure 7:
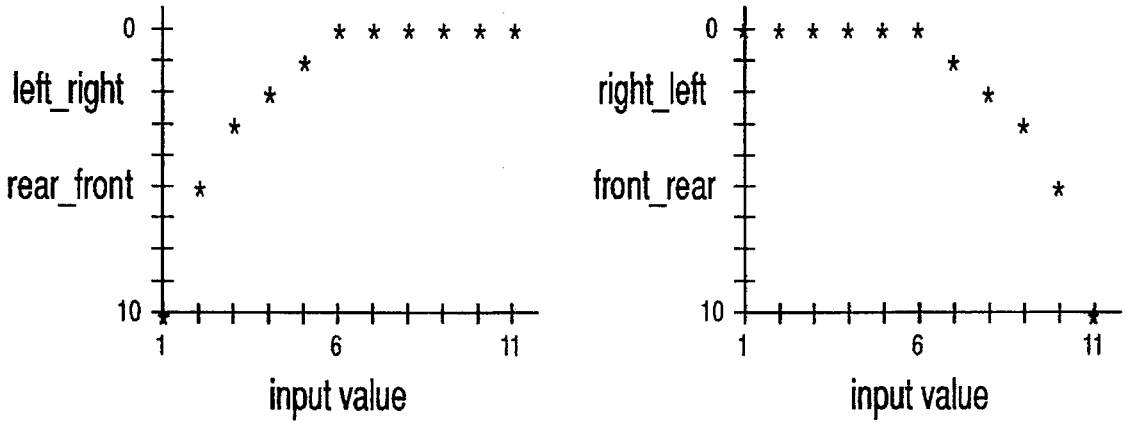
FIG. 7 is a diagram of control pot taper curves.

In order for the movement through the sound field to feel as natural as possible, the taper of each of the pots has been adjusted through the use of an array. Referring to FIG. 7 in this example, each "pot" is given 11 discrete values. The values of the pots are from 0 to 10 and are used as the index to the array's, that is if the value of the volume pot is 6, the value of the sixth element in the referenced array is used. There is no limit to the number of steps which can be implemented, with the greater the number of steps the greater the resolution of the system will be.

The control values and relationships follow:

Control Taper Arrays

```
left_right     [11] = { 10, 5, 3, 2, 1, 0, 0, 0, 0, 0, 0 };
right_left     [11] = { 0, 0, 0, 0, 0, 0, 1, 2, 3, 5, 10 };
rear_front     [11] = { 10, 5, 3, 2, 1, 0, 0, 0, 0, 0, 0 };
front_rear     [11] = { 0, 0, 0, 0, 0, 0, 1, 2, 3, 5, 10 };
attenuation    [11] = { 0, 1, 2, 3, 6, 9, 12, 18, 24, 48, 63 };
```

Volume and Balance

```
Master_level    = attenuation [volume]
Scaling         = max_attenuation − attenuation [volume]/20
```

The scaling factor 20 is derived from the formula (n − 1)*2 where n = 11 the number of discrete values of the volume control pots.

```
front_left_volume    =  Master_level +
                        Scaling * right_left [balance_x] +
                        Scaling * front_rear [balance_y]
front_right_volume   =  Master_level +
                        Scaling * left_right [balance_x] +
                        Scaling * front_rear [balance_y]
rear_left_volume     =  Master_level +
                        Scaling * right_left [balance_x] +
                        Scaling * rear_front [balance_y]
rear_right_volume    =  Master_level +
                        Scaling * left_right [balance_x] +
                        Scaling * rear_front [balance_y]
```

The scaling factor is chosen so that the balance controls will feel natural as the overall volume is changed and range that balance controls operate over is changed.

```
Volume =
attenuation [volume] +
(max_attenuation − attenuation [volume])/20 * right_left
[balance_x] +
(max_attenuation − attenuation [volume])/20 * front_rear
[balance_y]
```

Case 1: at maximum volume setting

```
volume = 0 + 63
* right_left_balance + 63 * front_left_balance
```

the effective range of each balance control is from 0 to 63

Case 2: at 50% of maximum volume setting

```
volume = 9 + 2 * right_left_balance +2 *
front_left_balance
```

the effective range of each balance control is from 0 to 20

Case 2: at 20% of maximum volume setting

```
volume = 24 + 1 * right_left_balance +1 * front_left_balance
```

the effective range of each balance control is from 0 to 10

(note: integer math is used in the examples)

Please note, in this particular implementation, the system used attenuation in the playback path and gain in the recording path. This method of controlling the balance will function in either environment. In the gain environment, the equations will be as follows:

```
Gain [11]       = { 15, 13, 11, 10, 8, 6, 5, 4, 2, 1, 0 }
Master_level    = Gain [volume]
Scaling         = 1/10
front_left_volume    =  Master_level *
                        Scaling * right_left [balance_x] *
                        Scaling * front_rear [balance_y]
front_right_volume   =  Master_level *
                        Scaling * left_right [balance_x] *
                        Scaling * front_rear [balance_y]
rear_left_volume     =  Master_level *
                        Scaling * right_left [balance_x] *
                        Scaling * rear_front [balance_y]
rear_right_volume    =  Master_level *
                        Scaling * left_right [balance_x] *
                        Scaling * rear_front [balance_y]
```

-continued

The General equation for the balance control can be given as:

$V_n$ = Master_level $F_n$[left/right] $F_n$[front/rear]

where n = channel

Figure 8:
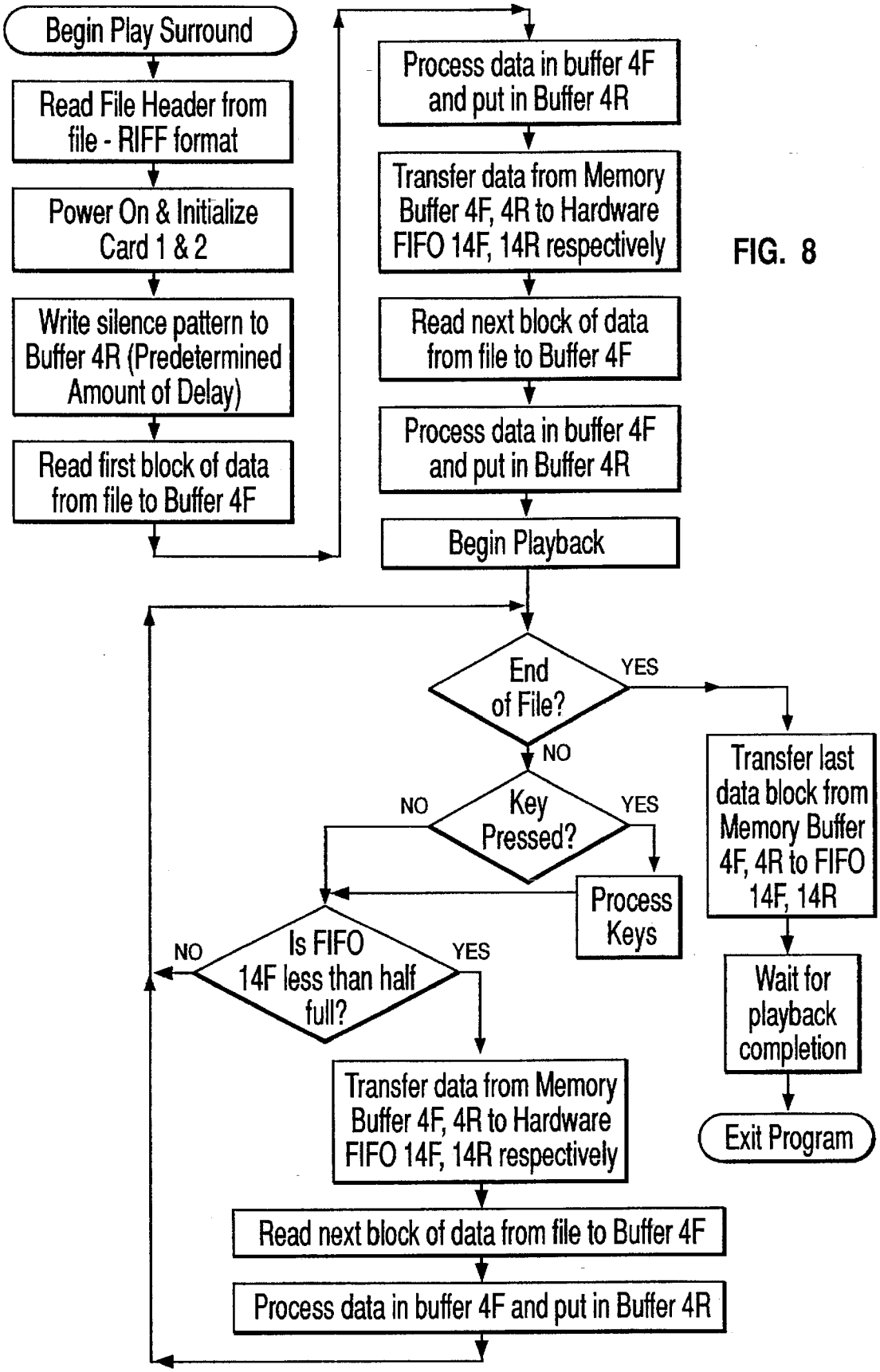
FIG. 8 is a flow chart of the operation of a specific implementation of the invention.

Referring to FIG. 8 a flow chart of specific implementation of the invention is depicted illustrating the operation of a surround sound system for playing an audio selection.

FIG. 9 illustrates pseudo code framed in C language to accomplish the process illustrated in FIG. 8.

As is clear from the aforesaid the advantages of the invention may be accomplished in various embodiments without departing from the scope of the invention as claimed below.

We claim:

1. Apparatus for creating a surround sound effect from an audio system using right and left channel audio data in conjunction with both front and rear pairs of right and left audio output devices, comprising:

means for storing in digital format the right and left channel audio data;

means for accessing the right and left channel audio data from the means for storing, in substantial concurrence;

front and rear audio buffer means respectively associated with the front and rear pairs of right and left audio output devices, the respective front and rear audio buffers operable in a FIFO format to output respective front and rear audio data in order of receipt;

means for selectively loading zero value data into front or rear one of said audio buffer means before loading audio data from the means for accessing;

means for simultaneously loading front and rear audio data into respective front and rear audio buffer means upon receipt from the means for accessing; and means for concurrently reading in the FIFO format audio data from the front and rear audio buffer means and substantially simultaneously transferring the read audio data in digital format to respective front and rear digital-to-analog conversion and audio output devices.

2. The apparatus of claim 1, further comprising:

indicator means in the front and rear audio buffer means responsive to the amount of audio data contained in each respective front and rear audio buffer means to signal said means for loading front and rear audio data when the combination of remaining zero value data and respective front or rear audio data is of a volume outside a selected range.

3. The apparatus of claim 1, further comprising:

wherein said means for selectively loading zero value data is adapted to add additional zero value data while front and rear audio data in digital format is being transferred to said respective front and rear digital-to-analog conversion and audio output devices.

* * * * *